US008567768B2

(12) United States Patent
Iwata et al.

(10) Patent No.: US 8,567,768 B2
(45) Date of Patent: Oct. 29, 2013

(54) DIRECT-CONTACT STEAM CONDENSER

(75) Inventors: Yoshihiro Iwata, Kawasaki (JP); Toshiaki Ozeki, Yokohama (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 586 days.

(21) Appl. No.: 12/781,264

(22) Filed: May 17, 2010

(65) Prior Publication Data

US 2010/0294468 A1 Nov. 25, 2010

(30) Foreign Application Priority Data

May 19, 2009 (JP) ..... 2009-120818

(51) Int. Cl.
*B01F 3/04* (2006.01)

(52) U.S. Cl.
USPC ..... 261/115; 261/118; 261/DIG. 10

(58) Field of Classification Search
CPC ..... B01F 3/04021
USPC ..... 261/115, 118, DIG. 10, DIG. 76
See application file for complete search history.

(56) References Cited

U.S. PATENT DOCUMENTS 199,267 A * 1/1878 Conkling ..... 261/19
1,372,409 A * 3/1921 Ehrhart ..... 261/118
2,913,232 A * 11/1959 Silverman ..... 261/40
2,939,685 A * 6/1960 Worn et al. ..... 165/114
3,423,078 A 1/1969 May
3,511,481 A * 5/1970 Daltry ..... 261/118
3,833,356 A * 9/1974 Luth ..... 75/462
3,834,133 A * 9/1974 Bow ..... 96/181
4,158,702 A * 6/1979 Archer ..... 423/210
4,810,268 A * 3/1989 Chambers et al. ..... 95/199
5,154,227 A * 10/1992 Csaba et al. ..... 165/112
6,231,648 B1 * 5/2001 Marlowe ..... 96/243

FOREIGN PATENT DOCUMENTS

JP 2000-130962 5/2000
JP 2007-23962 2/2007

OTHER PUBLICATIONS

K. Aikawa, et al., "MHI's Recent Achievements in the Field of Geothermal Power Generation", MHI Technical Rep., vol. 15, No. 2, 1978-3, pp. 175-191.
Y.Takahashi, et al., "Fundamental Study on Mixture Type Steam Condenser", MHI Technical Rep., vol. 9, No. 1, 1972, pp. 15-20.
Japanese Office Action with English translation mailed Feb. 12, 2013, in Japanese Patent Application No. 2009-120818, filed May 19, 2009.

* cited by examiner

*Primary Examiner* — Charles Bushey
(74) *Attorney, Agent, or Firm* — Oblon, Spivak, McClelland, Maier & Neustadt, L.L.P.

(57) ABSTRACT

In one embodiment, a direct-contact steam condenser includes: a steam cooling chamber; a inflow part; a plurality of first spray nozzles; and a water reservoir part. The inflow part leads turbine exhaust gas containing steam and non-condensable gas in a substantially horizontal direction into the steam cooling chamber. The plurality of first spray nozzles are disposed in the steam cooling chamber to be connected to a plurality of spray pipes extending along the direction in which the turbine exhaust gas is led in, and spray cooling water to the turbine exhaust gas. The water reservoir part is disposed under the steam cooling chamber to store condensate water that is condensed from the steam by the spraying of the cooling water.

9 Claims, 6 Drawing Sheets

DIRECT-CONTACT STEAM CONDENSER

CROSS-REFERENCE TO RELATED APPLICATIONS

This application is based upon and claims the benefit of priority from Japanese Patent Application No. 2009-120818, filed on May 19, 2009; the entire contents of which are incorporated herein by reference.

FIELD

Embodiments described herein relate generally to a direct-contact steam condenser.

BACKGROUND

A direct-contact steam condenser is used for geothermal power generation and so on. Conventional direct-contact steam condensers include a tray type and a spray type, the latter being called a spray condenser. In both of these methods, since steam condensation takes place by the direct contact of turbine exhaust steam and cooling water, how an area of the cooling water in contact with the steam is increased is important in view of performance. In the tray type, the turbine exhaust steam flows perpendicularly to the cooling water dropping down from a perforated tray and by the use of its dynamic pressure, the cooling water is atomized. In the spray type, the cooling water is atomized when being discharged to space through spray nozzles. In the spray type, since the flow velocity of the turbine exhaust steam is not required for the atomization of the water, it is possible to reduce a flow loss of the steam in the steam condenser.

Further, since a large volume of the cooling water is processed in the direct-contact steam condenser, it is necessary to prevent the occurrence of what is called water induction (phenomenon that the cooling water collecting in the steam condenser flows back toward a steam turbine due to some reason to damage a brade in high-speed rotation). A method conventionally adopted to solve this problem is to install a steam turbine exhaust pipe on an upper side and lead exhaust steam into a steam condenser from above the steam condenser. In this method, consideration need to be given so that an upper space of the steam turbine has a large height, the steam turbine is installed at a high position, and the steam condenser is installed in a lower position, or the like, which gives a great influence not only on the equipment but also on construction cost.

A geothermal power plant utilizes steam extracted from the earth and, as a driving force of a steam turbine, uses a heat drop decided by a differential pressure to a pressure of a steam condenser, thereby generating power. The steam pressure when the steam is extracted from the earth varies depending on a site where the steam is extracted, but is generally about 5 kg·f/cm$^2$ to about 8 kg·f/cm$^2$, which is considerably lower than a main steam pressure of an ordinary thermal power plant. Further, since the geothermal power plant is generally installed in a district having a scarce cooling water resource, a method of recycling condensed steam as cooling water is adopted. Therefore, in many cases, the cooling water has a higher temperature than sea water and river water. In the steam condenser, even if it is a direct-contact type, the pressure cannot be made lower than a saturation pressure at the temperature of water produced after steam and cooling water are mixed, and therefore, it is important to reduce a flow loss of the steam when the steam flows from the steam turbine to the steam condenser. An effective method to achieve this is an axial flow exhaust method in which an exhaust direction of a steam turbine is set to an axial direction of the turbine that is a flow direction of the steam passing through a brade.

As described above, the steam condenser is generally of what is called a downflow type in which the exhaust steam flows downward from above the steam condenser to be led therein. In this type, a bend for changing the flow direction to the downward direction needs to be provided in an exhaust pipe, so that a flow loss occurs in the bend and a steam condenser needs to be installed at a lower position, which gives a great influence also on construction cost.

DETAILED DESCRIPTION

In one embodiment, a direct-contact steam condenser includes: a steam cooling chamber; a inflow part; a plurality of first spray nozzles; and a water reservoir part. The inflow part leads turbine exhaust gas containing steam and non-condensable gas in a substantially horizontal direction into the steam cooling chamber. The plurality of first spray nozzles are set in the steam cooling chamber to be connected to a plurality of spray pipes extending along the direction in which the turbine exhaust gas is led in, and spray cooling water to the turbine exhaust gas. The water reservoir part is set under the steam cooling chamber to store condensate water that is condensed from the steam by the spraying of the cooling water.

Hereinafter, embodiments of the present invention will be described in detail.

(First Embodiment)

Figure 1:
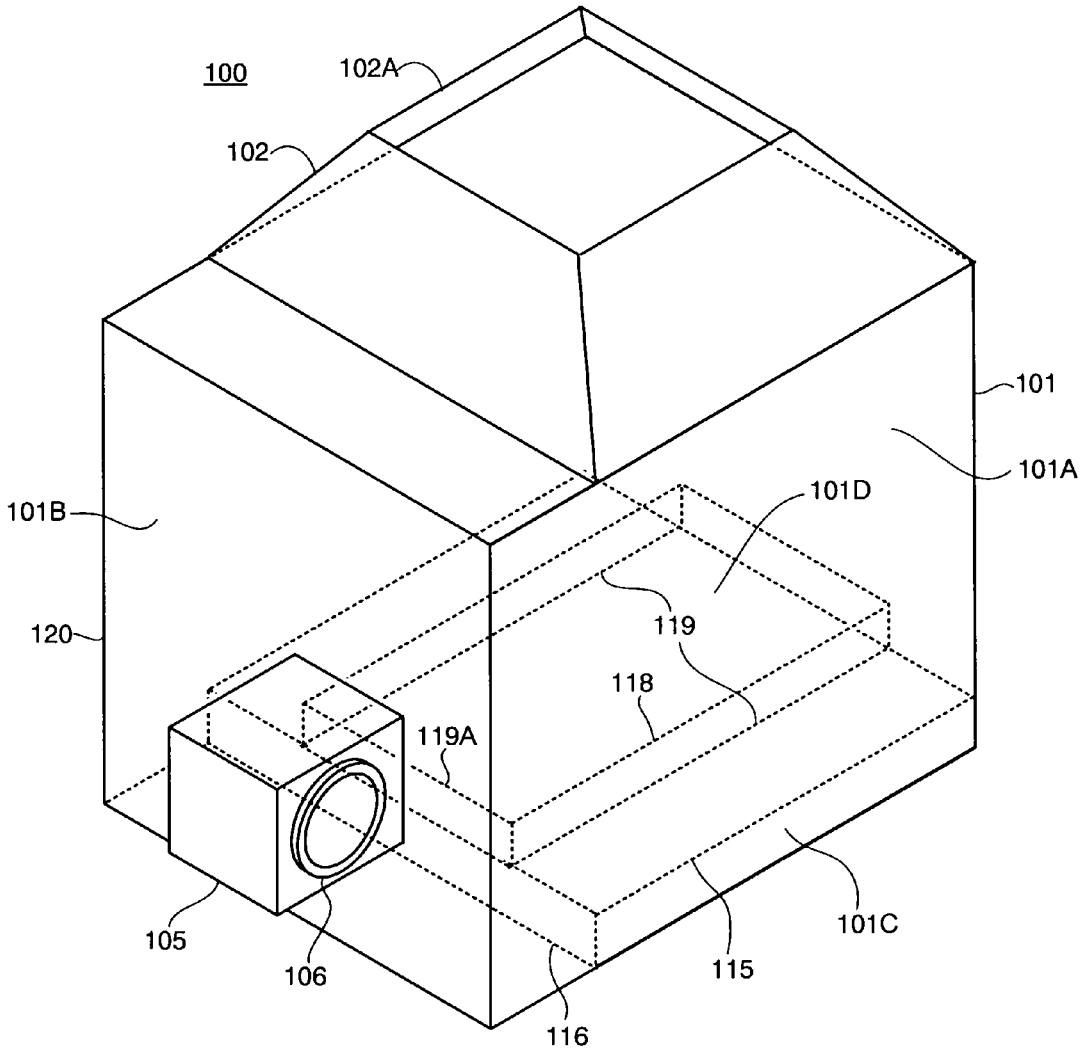
FIG. 1 is a perspective view showing an external appearance of a spray condenser 100 according to a first embodiment of the present invention.
Figure 2:
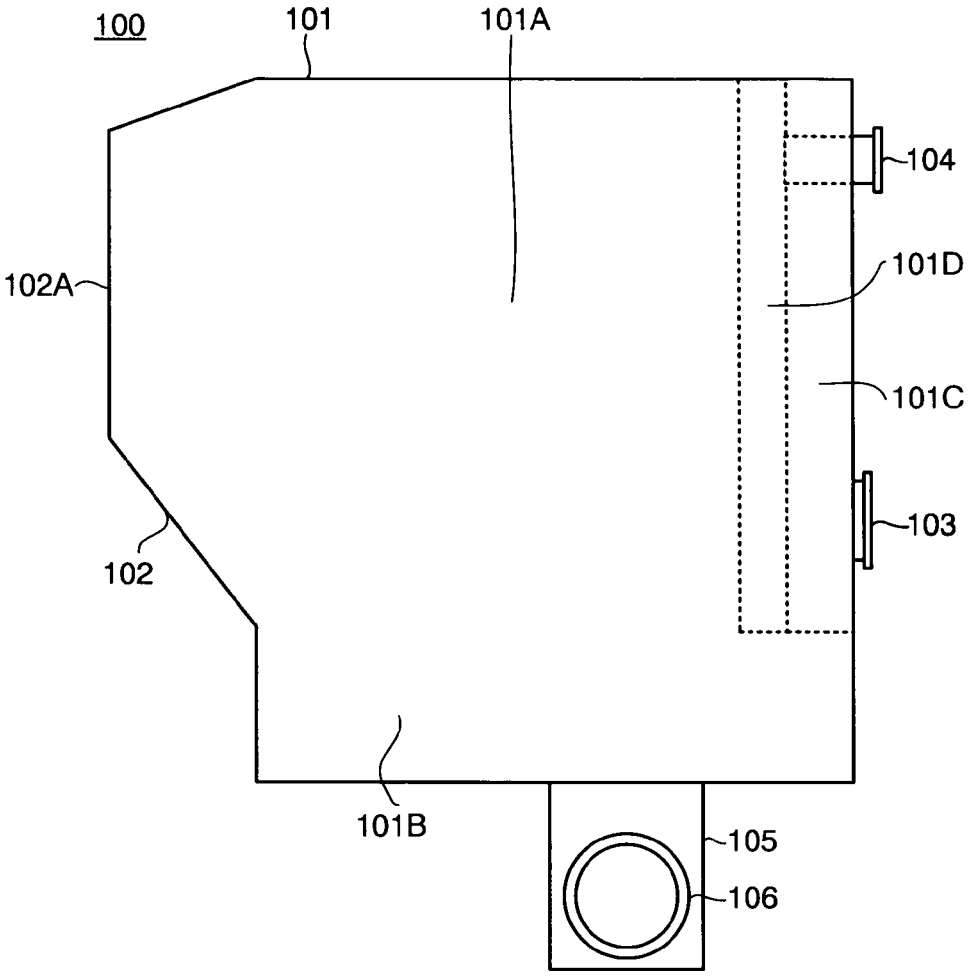
FIG. 2 is a side view showing the external appearance of the spray condenser 100 according to the first embodiment of the present invention.
Figure 3:
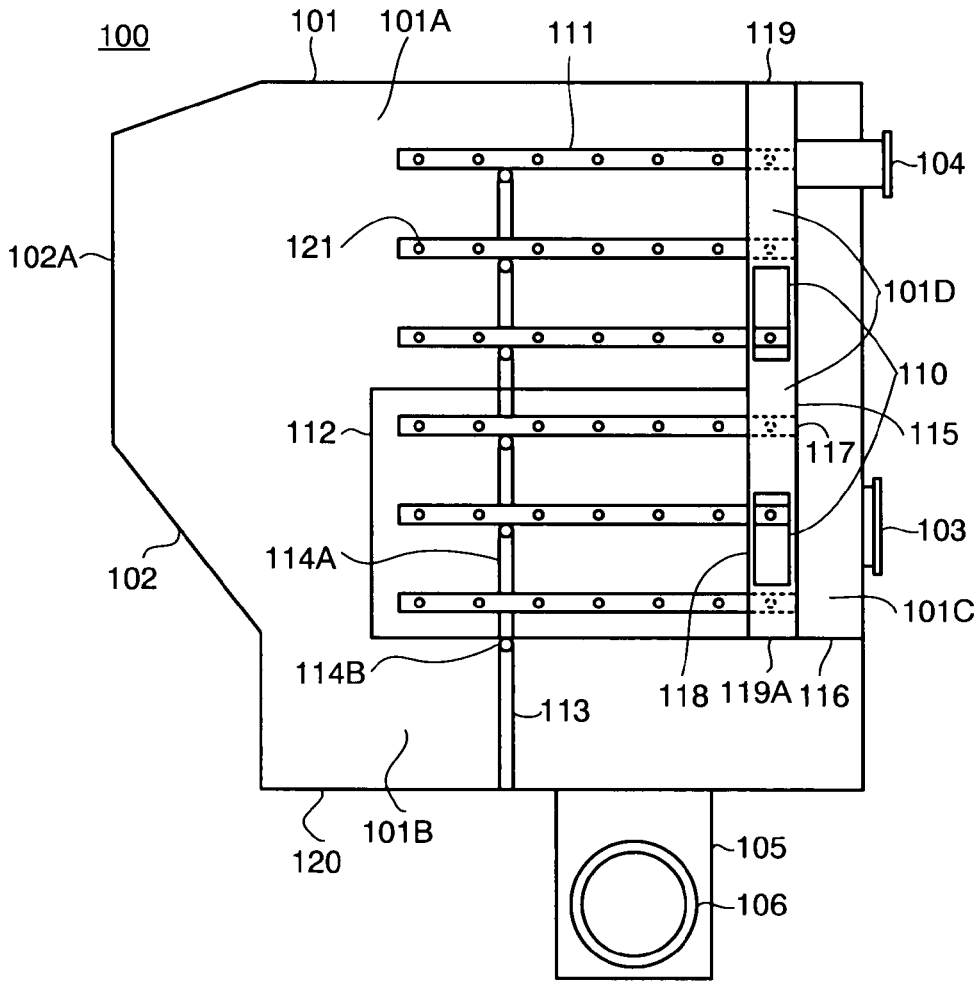
FIG. 3 is a side view showing an inner part of the spray condenser 100 according to the first embodiment of the present invention.
Figure 4:
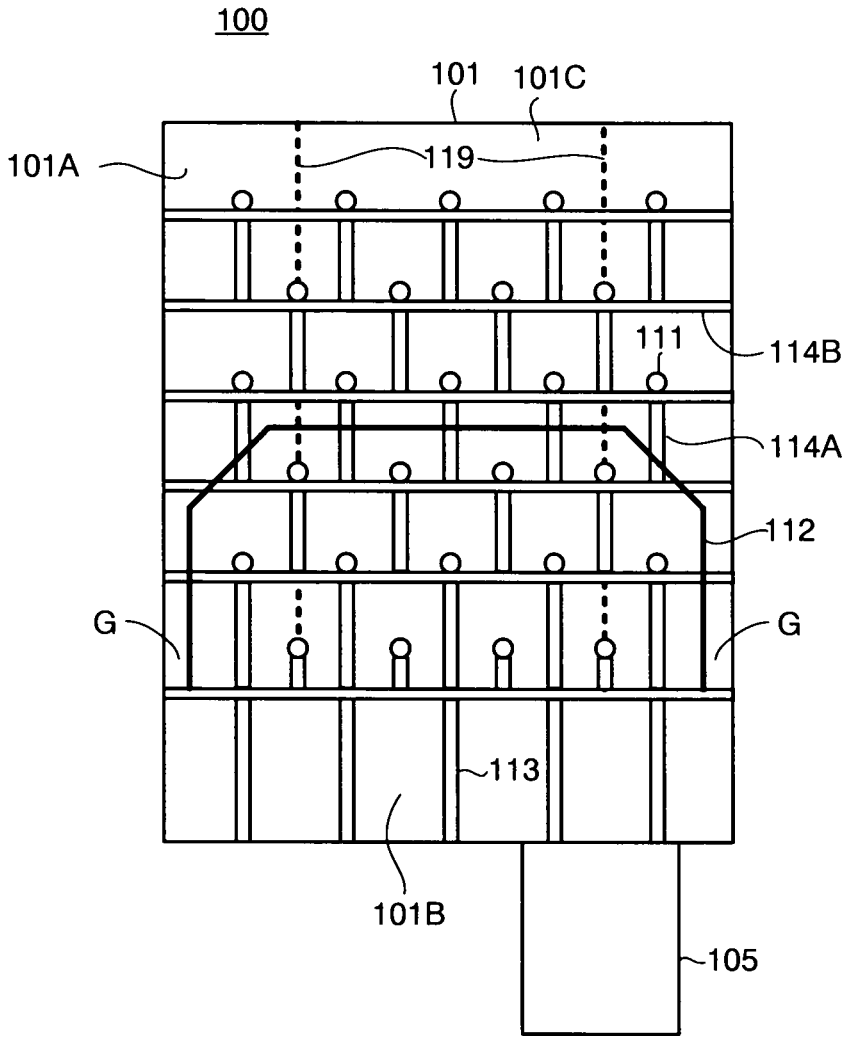
FIG. 4 is a front view showing the inner part of the spray condenser 100 according to the first embodiment of the present invention seen from a front side.

A spray condenser 100 according to a first embodiment of the present invention will be described with reference to FIG. 1 to FIG. 4. FIG. 1 is a perspective view showing an external appearance of the spray condenser 100. FIG. 2 is a side view showing the external appearance of the spray condenser 100. FIG. 3 is a side view showing an inner part of the spray condenser 100. FIG. 4 is a front view showing the inner part of the spray condenser 100.

The spray condenser 100 is a direct-contact steam condenser that condenses (liquefies) steam (turbine exhaust steam) contained in exhaust gas (turbine exhaust gas) discharged from a steam turbine (geothermal steam turbine) of, for example, a geothermal power plant by cooling the steam. The turbine exhaust gas contains the steam and non-condensable (NC) gas. The non-condensable gas is gas not condensing even when cooled by cooling water and is, for example, carbon dioxide gas ($CO_2$) or hydrogen sulfide gas ($H_2S$).

The spray condenser 100 has a main body 101, a turbine exhaust steam inlet nozzle 102, a cooling water inlet nozzle 103, a gas outlet nozzle 104, a hot well outlet box 105, a condensate water outlet nozzle 106, and spray pipes 111.

The main body 101 constitutes a main part of the spray condenser 100 and is a container whose outer shape is a box shape. An inner space of the main body 101 can be divided into a steam cooling chamber 101A, a hot well 101B, a cooling water chamber 101C, and a gas cooling chamber 101D. They will be described later in detail.

The turbine exhaust gas inlet nozzle 102 is a member leading the turbine exhaust gas into the steam cooling chamber 101A and is set on a left side of the steam cooling chamber 101A in terms of the direction in FIG. 2 and FIG. 3. The turbine exhaust gas inlet nozzle 102 can lead the turbine exhaust gas into the steam cooling chamber 101A in a horizontal direction via an opening portion 102A set on its left side end. The turbine exhaust gas inlet nozzle 102 has a truncated quadrangular pyramid shape as a whole (having a trapezoidal side surface) and its cross section becomes smaller toward the opening portion 102A. The opening portion 102A has a rectangular or circular opening. When the opening is circular, the opening portion 102A includes a rectangular plate having the circular opening. The turbine exhaust gas inlet nozzle 102 functions as a inflow part leading the turbine exhaust gas in the horizontal direction into the steam cooling chamber.

The steam cooling chamber 101A holds a space where the steam in the turbine exhaust gas (turbine exhaust steam) is cooled. A top portion of the steam cooling chamber 101A is in a flat plate shape. As will be described later, the cooling water is sprayed to the turbine exhaust steam in the steam cooling chamber 101A to be directly cooled, so that condensate water (water condensed from the turbine exhaust steam) is generated.

The hot well 101B is set under the steam cooling chamber 101A (lower portion of the main body 101) to store the condensate water generated in the steam cooling chamber 101A and the used cooling water. As shown in FIG. 1 to FIG. 4, in this embodiment, the hot well 101B has a rectangular cross section and is capable of storing a large volume of the condensate water therein. However, an upper portion of the hot well 101B can have a semicircular cross section. The hot well 101B has a bottom plate 120 in a flat plate shape. The hot well 101B functions as a water reservoir part storing the condensate water condensed from the steam by the spraying of the cooling water.

On an underside of the bottom plate 120 of the hot well 101B, the hot well outlet box 105 having a circular or rectangular cross section is attached. The condensate water outlet nozzle 106 is attached on a lateral side or an underside of the hot well outlet box 105, enabling the discharge of the condensate water.

The cooling water inlet nozzle 103, which is intended to lead the cooling water into the spray condenser 100, is attached substantially at the center of a right side wall surface of the main body 101 (opposite the turbine exhaust gas inlet nozzle 102) to be connected to the cooling water chamber 101C.

The cooling water chamber 101C is a space where the cooling water flowing therein via the cooling water inlet nozzle 103 passes to be distributed to the spray pipes 111, and is set along substantially the entire wall surface on which the cooling water inlet nozzle 103 is attached, except a lower portion (hot well 101B) of the wall surface. The cooling water chamber 101C is separated from the other spaces (the steam cooling chamber 101A, the hot well 101B, the gas cooling chamber 101D) in the main body 101 by a water chamber partition plate 115 and a water chamber partition bottom plate 116.

Many spray pipe opening portions 117 are provided in the water chamber partition plate 115 at equal intervals. The spray pipes 111 are attached in the horizontal direction to the spray pipe opening portions 117 respectively. The spray pipes 111, which are pipes for supplying the cooling water to spray nozzles 121, pass through the gas cooling chamber 101D to extend straight in the direction toward the turbine exhaust gas inlet nozzle 102. As a result, a large number of the spray pipes 111 are set horizontally in the steam cooling chamber 101A. The reason why the axial direction of the spray pipes 111 is horizontal is to make the axial direction match the inflow direction of the turbine exhaust gas, thereby reducing a flow loss of the turbine exhaust gas. Note that the other ends of the spray pipes 111 are closed.

A large number of the spray nozzles (sprayers) 121 are attached to each of the spray pipes 111. The spray nozzles 121 are attached, being deviated from one another by a half pitch. The spray nozzles 121 are attached basically in a horizontal direction (substantially perpendicularly to the inflow direction of the turbine exhaust gas). Even without any spray nozzle 121 in a vertical direction, the cooling water is sprayed in the vertical direction owing to the gravity. However, the spray nozzles 121 are attached also to a top side of only the uppermost spray pipe 111. This is intended to spray the cooling water to an area above the uppermost spray pipe 111.

The spray nozzles 121 are attached also to the spray pipes 111 inside the gas cooling chamber 101D. This is intended to cool the turbine exhaust gas (residual steam and non-condensable gas).

At one middle position or more of the spray pipes 111, spray pipe reinforcing members 113, 114A, 114B are set to support horizontal- and lateral-direction weights and loads of the spray pipes 111. These spray pipe reinforcing members 113, 114A, 114B are connected to one another and are finally fixed to upper, lower, left, and right plates on both sides of the main body 101. This is intended to support an external pressure load of the main body 101 and the weights of the spray pipes 111 and the cooling water present in the spray pipes 111.

Inside the steam cooling chamber 101A, an inner partition plate 112 is attached so as to divide the inner space into an upper portion and a lower portion (an upper portion and a lower portion of the steam cooling chamber 101A). The inner partition plate 112 divides the spray pipes 111 into two upper and lower sets (upper spray pipes and lower spray pipes) and covers the lower spray pipes. One end of the inner partition plate 112 is connected to a gas cooling chamber enclosure plate 118 and the water chamber partition plate 115, and the other end thereof is open. Vertical portions (side plates) on both sides of the inner partition plate 112 are apart from side plates of the main body 101 with appropriate gaps G therebetween. This is intended to lead the condensate water generated in the upper portion of the steam cooling chamber 101A and the sprayed cooling water to the hot well 101B.

The gas cooling chamber 101D is a space where the turbine exhaust gas cooled in the steam cooling chamber 101A, in particular, the non-condensable gas, is cooled, and is separated from the steam cooling chamber 101A by the gas cooling chamber enclosure plate 118, gas cooling chamber side plates 119, and a gas cooling chamber bottom plate 119A (in FIG. 4, the gas cooling chamber side plates 119 are shown by the broken lines for easier discrimination from other members).

The gas cooling chamber enclosure plate 118 is attached in parallel with the water chamber partition plate 115, and the spray pipes 111 pass therethrough. As previously described, the spray nozzles 121 are attached to the spray pipes 111 inside the gas cooling chamber 101D (the spray pipes 111 passing through the gas cooling chamber 101D) to spray the cooling water for cooling the turbine exhaust gas (the residual steam and non-condensable gas).

The gas cooling chamber side plates 119 are attached to both sides of the gas cooling chamber enclosure plate 118, and as shown in FIG. 4, extend to a top plate of the main body 101. Two upper and lower opening portions (gas cooling chamber inlets 110) are provided in each of the gas cooling chamber side plates 119. This is intended to lead the turbine exhaust gas, in particular, the non-condensable gas, from the steam cooling chamber 101A into the gas cooling chamber 101D. The upper and lower gas cooling chamber inlets 110 are opened toward a space above the inner partition plate 112 and to a space on an inner side of the inner partition plate 112 respectively. This is intended for efficient intake of the turbine exhaust gas from the upper portion and the lower portion of the steam cooling chamber 101A respectively.

The gas outlet nozzle 104 is attached to an upper portion of the right side wall surface (opposite the turbine exhaust gas inlet nozzle 102) of the main body 101. The gas outlet nozzle 104 communicates with the gas cooling chamber 101D. A vacuum pump or an air ejector, not shown, are connected to the gas outlet nozzle 104, so that the turbine exhaust gas remaining after the condensation takes place in the steam cooling chamber 101A is discharged after cooled in the gas cooling chamber 101D.

(Operation of Spray Condenser 100)

Hereinafter, the operation of the spray condenser 100 will be described.

Air in the spray condenser 100 is discharged by the vacuum pump or the air ejector connected to the gas outlet nozzle 104, so that a pressure in the spray condenser 100 is reduced to an atmospheric pressure or lower.

Due to a differential pressure from the atmospheric pressure, the cooling water from a cooling water supplier such as a cooling tower, not shown, flows into the spray condenser 100 via the cooling water inlet nozzle 103. The cooling water flowing via the cooling water inlet nozzle 103 passes through the cooling water chamber 101C and the spray pipes 111 to be ejected (sprayed) in the form of water droplet particles from the spray nozzles 121 into the steam cooling chamber 101. The ejected cooling water finally drops down by the gravity, and the lower a space is, the higher the density of the cooling water occupying the space, since the cooling water from above drops to the lower space.

The cooling water ejected to the upper portion of the steam cooling chamber 101A drops onto the inner partition plate 112 located at an intermediate position and further branches off to drop in the gaps G between the inner partition wall 112 and the main body 101, and drops to the hot well 101B to collect therein.

Further, the cooling water ejected from the spray nozzles 121 of the spray pipes 111 in the lower portion of the steam cooling chamber 101A does not mix with the cooling water from above owing to the inner partition plate 112, so that in this space (the lower portion of the steam cooling chamber 101A), the condensation and heat transfer progress under substantially the same condition as that in the upper space (the upper portion of the steam cooling chamber 101A).

The water dropping to and collecting in the hot well 101B is pumped out via the condensate water outlet nozzle 106 by a hot well pump, not shown, and water level of the hot well 101B is controlled to be constant by a level controller.

The turbine exhaust gas flows via the turbine exhaust gas inlet nozzle 102 deeper in the longitudinal direction of the spray pipes 111. While flowing in this direction, the turbine exhaust gas is cooled and condensed by the cooling water which is ejected from the spray nozzles 121 and atomized. As a result, the condensation of the steam in the turbine exhaust gas more progresses as it goes deeper in the longitudinal direction of the spray pipes 111 from the turbine exhaust gas inlet nozzle 102, so that the concentration of the non-condensable gas in the turbine exhaust gas becomes higher as it goes deeper. That is, the concentration distribution of the non-condensable gas occurs in the longitudinal direction of the spray pipes 111.

The turbine exhaust gas whose condensation has progressed flows from the steam cooling chamber 101A into the gas cooling chamber 101D via the gas cooling chamber inlets 110, and the accompanying steam condenses by the cooling water sprayed from the spray nozzles 121 installed inside the gas cooling chamber 101D, so that the steam exhaust gas having an increased concentration of the non-condensable gas is discharged outside the system via the gas outlet nozzle 104 by the vacuum pump (or the air ejector), not shown.

(Advantages of Spray Condenser 100)

The spray condenser 100 can have the following advantages (1), (2).

(1) Reduction in Pressure Loss (Flow Loss)

In the spray condenser 100, the turbine exhaust gas is led horizontally from the lateral direction. Therefore, a pressure loss (flow loss) when the turbine exhaust gas is led in can be made lower than that in a method of leading the turbine exhaust gas from an upper direction.

In the method of leading the turbine exhaust gas from the upper direction, the gas is discharged to an upper side of a steam turbine, and after led around by an exhaust pipe to an area above a spray condenser or a jet condenser, the gas is changed in its flow direction by a bend or another method to be led into a container (condenser). Accordingly, the steam is forcibly changed in its flow direction, which necessarily causes a pressure loss.

On the other hand, since it is possible to lead the turbine exhaust gas in the horizontal direction into the spray condenser 100, the turbine exhaust gas can be discharged in the axial direction of the steam turbine to be led into the spray condenser 100 without any change in its flow direction. Therefore, a device for changing the flow direction such as the bend need not be provided in an exhaust pipe provided on the way, which enables a reduction in the pressure loss.

The reduction in the pressure loss leads to a decrease in exhaust pressure of the steam turbine, and consequently, makes it possible to obtain a larger volume of power generation with the same steam flow rate. That is, an output of a power plant is increased.

Incidentally, it also contributes to the reduction in the pressure loss that the spray pipes 111 are set with its axial direction being set horizontal and thus matching the lead-in direction of the turbine exhaust gas so as not to obstruct the flow of the turbine exhaust gas.

(2) Prevention of Water Induction

In the method of leading the turbine exhaust gas horizontally, it is thought that water induction is more likely to occur than in a method of leading the turbine exhaust gas from above. In the spray condenser 100, the water induction is prevented in the following manner.

Reduction in a Flow Loss of the Turbine Exhaust Gas

As previously described, the reduction in the flow loss of the turbine exhaust gas is realized. The reduction in the flow loss ensures the velocity of the turbine exhaust gas flowing via the turbine exhaust gas inlet nozzle 102, which leads to the prevention of the backflow of the water (the cooling water or the condensate water) in the spray condenser 100 to the steam turbine.

Placement of the Hot Well 101B

Placing the hot well 101B sufficiently lower than the opening portion 102A of the turbine exhaust gas inlet nozzle 102 can prevent the backflow of the water (the cooling water or the condensate water) in the hot well 101B to the opening portion 102A. However, instead of the hot well 101B itself, the level of the water in the hot well 101B may be set sufficiently lower than the opening portion 102A. That is, the water is discharged via the condensate water outlet nozzle 106 as necessary so that the water level of the hot well 101B does not become too high.

Spraying Direction of the Cooling Water

As previously described, the cooling water is ejected from the spray nozzles 121. In view of preventing the water induction, it is also important that the ejection direction is not a direction toward the opening portion 102A of the turbine exhaust gas inlet nozzle 102. In the above-described embodiment, the cooling water is ejected in the perpendicular direction to the flow direction (horizontal direction) of the turbine exhaust gas (ejected in the lateral direction and the upward direction).

(Second Embodiment)

Figure 5:
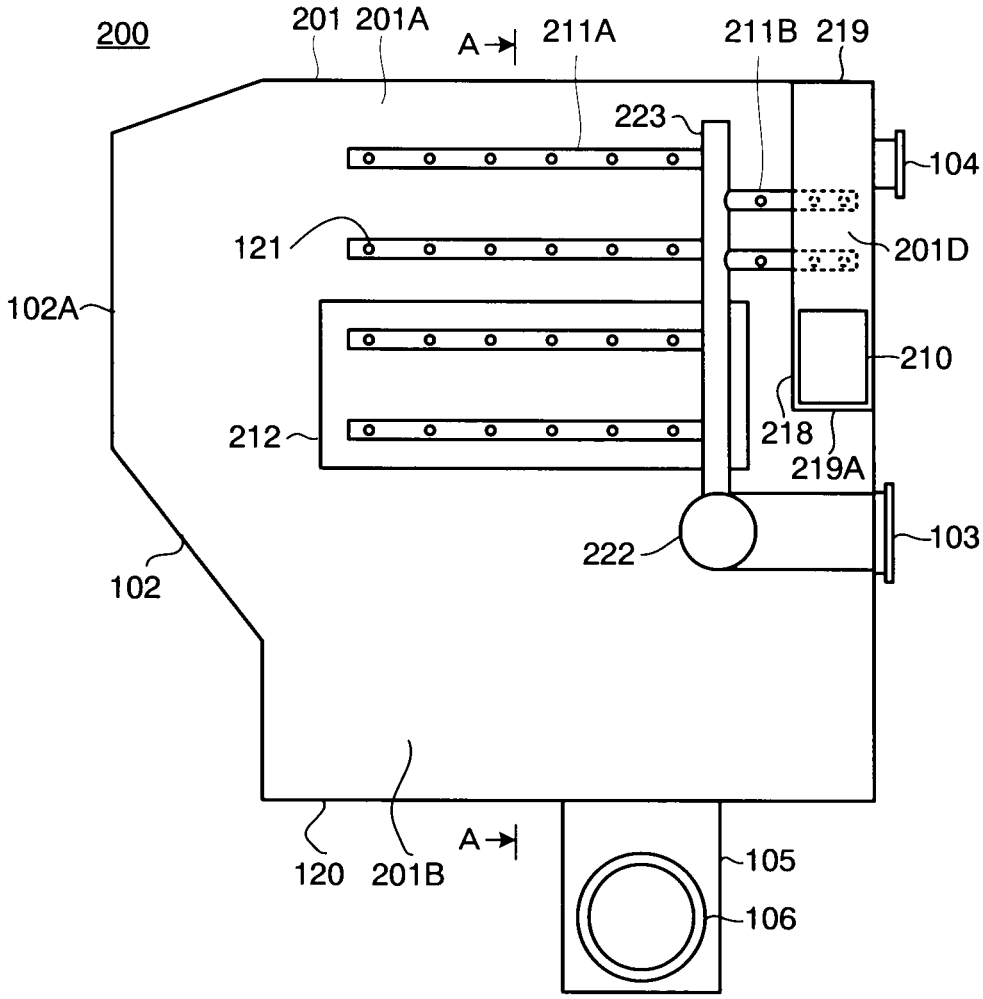
FIG. 5 is a side view showing an inner part of a spray condenser 200 according to a second embodiment of the present invention.

Next, a spray condenser 200 according to a second embodiment of the present invention will be described by using FIG. 5 and FIG. 6. In FIG. 5, which is a view corresponding to FIG. 3, spray pipe reinforcing members 113, 114A, 114B and so on are omitted for easier view. Further, FIG. 6 is a view showing a cross section seen in the arrow A-A direction in FIG. 5.

The spray condenser 200 has a main body 201, a turbine exhaust steam inlet nozzle 102, a cooling water inlet nozzle 103, a gas outlet nozzle 104, a hot well outlet box 105, a condensate water outlet nozzle 106, and spray pipes 211A, 211B. An inner space of the main body 201 can be divided into a steam cooling chamber 201A, a hot well 201B, and a gas cooling chamber 201D. The spray pipes 211A, 211B each have spray nozzles 121 and they eject cooling water for cooling turbine exhaust gas in the steam cooling chamber 201A and the gas cooling chamber 201D respectively. Incidentally, the number of the spray pipes 211A is less than the number of the spray pipes 111 of the first embodiment but may be equal to the number of the spray pipes 111.

An inner partition plate 212 is attached inside the steam cooling chamber 201A. The inner partition plate 212 divides the spray pipes 211A into two upper and lower sets (upper spray pipes and lower spray pipes) and covers the lower spray pipes. Unlike the inner partition plate 112 of the first embodiment, the inner partition plate 212 have open ends on both sides. Vertical portions on the both sides of the inner partition plate 212 are apart from side plates of the main body 201 with appropriate gaps therebetween. This is intended to lead condensate water generated in an upper portion of the steam cooling chamber 201A and the sprayed cooling water into the hot well 201B.

Figure 6:
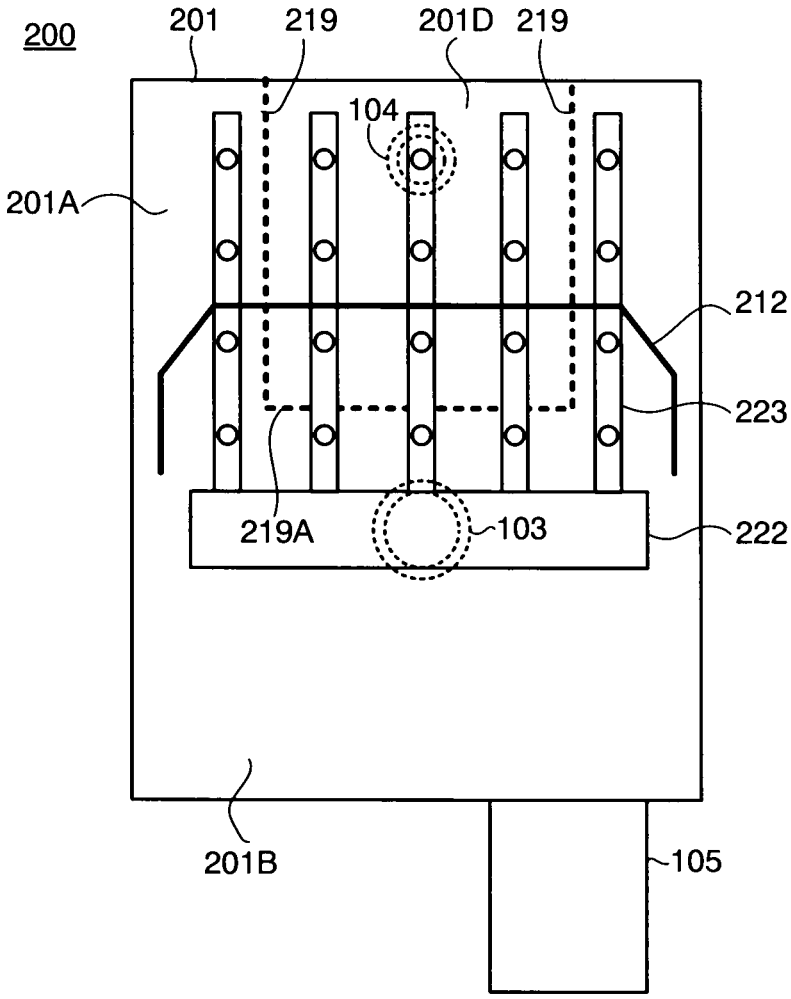
FIG. 6 is a cross-sectional view showing a cross section of the spray condenser 200 according to the second embodiment of the present invention.

The gas cooling chamber 201D is separated from the steam cooling chamber 201A by a gas cooling chamber enclosure plate 218, gas cooling chamber side plates 219, and a gas cooling chamber bottom plate 219A (in FIG. 6, the gas cooling chamber side plates 219 and the gas cooling chamber bottom plate 219A are shown by the broken lines for easier discrimination from other members).

The gas cooling chamber side plates 219 extend to a top plate of the main body 201 as shown in FIG. 6. One opening portion (gas cooling chamber inlet 210) is provided in each of the gas cooling chamber side plates 219. In this embodiment, unlike the first embodiment, the gas cooling chamber inlet 210 is not set on each of upper and lower sides. This is because, even if two upper and lower gas cooling chamber inlets 210 are not provided, the turbine exhaust gas can be efficiently taken in from the steam cooling chamber 201A since the both ends of the inner partition plate 212 are open.

In the spray condenser 200, a cooling water distribution pipe 222 and cooling water stand pipes 223 are installed instead of the cooling chamber 101C in FIG. 3, and the spray pipes 211A, 211B are connected to the cooling stand pipes 223 to be supplied with the cooling water. Thus using the cooling water distribution pipe 222 and so on eliminates a need for adopting the complicated structure of the first embodiment where the spray pipes 111 pass through the gas cooling chamber 101D.

Though the internal structure is different from that of the first embodiment, the reduction in a pressure loss (flow loss) and the prevention of water induction are achieved as in the first embodiment.

While certain embodiments have been described, these embodiments have been presented by way of example only, and are not intended to limit the scope of the inventions. Indeed, the novel apparatuses described herein may be embodied in a variety of other forms; furthermore, various omissions, substitutions and changes in the form of the apparatuses described herein may be made without departing from the spirit of the inventions. The accompanying claims and their equivalents are intended to cover such forms or modifications as would fall within the scope and spirit of the inventions.

What is claimed is:

1. A direct-contact steam condenser, comprising:

a steam cooling chamber;

a inflow part leading turbine exhaust gas containing steam and non-condensable gas in a substantially horizontal direction into the steam cooling chamber;

a partition plate partitioning the steam cooling chamber into an upper portion and a lower portion and opened toward the inflow part;

a plurality of first spray nozzles disposed in the upper portion of the steam cooling chamber to be connected to a plurality of first spray pipes extending along the direction in which the turbine exhaust gas is led in, and spraying cooling water to the turbine exhaust gas;

a plurality of second spray nozzles disposed in the lower portion of the steam cooling chamber, to be connected to a plurality of second spray pipes extending along the direction in which the turbine exhaust gas is led in, and spraying cooling water to the turbine exhaust gas; and a water reservoir part disposed under the steam cooling chamber to store condensate water that is condensed from the steam by the spraying of the cooling water.

2. The direct-contact steam condenser according to claim 1, wherein the first and second spray nozzles spray the cooling water substantially in a perpendicular direction to the turbine exhaust gas that is led in.

3. The direct-contact steam condenser according to claim 1, further comprising:

a gas cooling chamber which is disposed opposite the inflow part in the steam cooling chamber and into which the non-condensable gas remaining in the turbine exhaust gas to which the cooling water has been sprayed flows; and a plurality of third spray nozzles spraying the cooling water to the non-condensable gas in the gas cooling chamber.

4. The direct-contact steam condenser according to claim 3, wherein third spray pipes pass through the gas cooling chamber.

5. The direct-contact steam condenser according to claim 4, wherein the third spray nozzles are connected to the first spray pipes passing through the gas cooling chamber.

6. The direct-contact steam condenser according to claim 1, further comprising, a cooling water chamber into which the cooling water flows to be supplied to the first and second spray nozzles.

7. The direct-contact steam condenser according to claim 1, further comprising:

a cooling water distribution pipe into which the cooling water flows; and cooling water stands which are connected to the cooling water distribution pipe and to which the cooling water is distributed, wherein the first and second spray nozzles are supplied with the cooling water from the cooling water stands.

8. The direct-contact steam condenser according to claim 3, wherein the gas cooling chamber is separated from the steam cooling chamber by a gas cooling chamber enclosure plate, a plurality of chamber side plates, and a gas cooling chamber bottom plate, each of the gas cooling chamber side plates has an opening portion, and the non-condensable gas is lead from the steam cooling chamber to the gas cooling chamber through the opening portion.

9. The direct-contact steam condenser according to claim 8, wherein the partition plate includes an upper plate and a plurality of side plates, the upper plate is connected to the gas cooling chamber enclosure plate, and the side plates are connected to the upper plate and lead the condensate water on the upper plate to the water reservoir part.

* * * * *